US008246299B2

(12) United States Patent
Razzell et al.

(10) Patent No.: US 8,246,299 B2
(45) Date of Patent: Aug. 21, 2012

(54) ROTOR SEAL SEGMENT

(75) Inventors: Anthony G. Razzell, Derby (GB); Steven M. Hillier, Manchester (GB)

(73) Assignee: Rolls-Royce, PLC, London (GB)

( * ) Notice: Subject to any disclaimer, the term of this patent is extended or adjusted under 35 U.S.C. 154(b) by 1207 days.

(21) Appl. No.: 12/068,181

(22) Filed: Feb. 4, 2008

(65) Prior Publication Data

US 2008/0206046 A1 Aug. 28, 2008

(30) Foreign Application Priority Data

Feb. 28, 2007 (GB) ..... 0703827.6

(51) Int. Cl.
*F01D 11/08* (2006.01)

(52) U.S. Cl. ..... 415/173.1; 415/116; 415/213.1

(58) Field of Classification Search ..... 415/173.1, 415/116, 213.1
See application file for complete search history.

(56) References Cited

U.S. PATENT DOCUMENTS

| | | | | |
|---|---|---|---|---|
| 4,679,981 | A * | 7/1987 | Guibert et al. | 415/116 |
| 5,962,076 | A | 10/1999 | Mason et al. | |
| 6,139,257 | A * | 10/2000 | Proctor et al. | 415/115 |
| 6,702,550 | B2 * | 3/2004 | Darkins et al. | 415/116 |
| 7,278,820 | B2 * | 10/2007 | Keller | 415/173.1 |
| 2004/0047726 | A1 | 3/2004 | Morrison | |
| 2005/0129499 | A1 | 6/2005 | Morris et al. | |

FOREIGN PATENT DOCUMENTS

| | | | |
|---|---|---|---|
| EP | 1 548 234 | A2 | 6/2005 |
| EP | 1 676 981 | A2 | 7/2006 |
| GB | 2 090 333 | A | 7/1982 |
| GB | 2 169 037 | A | 7/1986 |

* cited by examiner

*Primary Examiner* — Ninh H Nguyen
(74) *Attorney, Agent, or Firm* — Oliff & Berridge, PLC

(57) ABSTRACT

A ceramic seal segment for a shroud ring of a rotor of a gas turbine engine, the ceramic seal segment positioned radially adjacent the rotor and characterized by being a hollow section that defines an inlet and an outlet for the passage of coolant therethrough.

20 Claims, 4 Drawing Sheets

ROTOR SEAL SEGMENT

The present invention relates to a ceramic shroud ring for a rotor of a gas turbine engine.

U.S. Pat. No. 5,962,076 discloses a ceramic matrix composite (CMC) seal segment for a turbine rotor of a gas turbine engine. Although, CMCs have a very high temperature capability, however the desire to increase turbine temperatures mean this CMC shroud will have a decrease service life.

Therefore it is an object of the present invention to provide a shroud ring comprising ceramic matrix composite and a cooling arrangement.

In accordance with the present invention a ceramic seal segment for a shroud ring of a rotor of a gas turbine engine, the ceramic seal segment positioned radially adjacent the rotor and characterized by being a hollow section that defines an inlet and an outlet for the passage of coolant therethrough.

Preferably, an impingement plate is provided within the hollow section seal segment, the impingement plate defining an array of holes through which the coolant passes and thereby creates a plurality of coolant jets that impinge on a radially inner surface or a radially inner wall of the seal segment.

Alternatively, a cascade impingement device is provided within the hollow section seal segment, the cascade impingement device defining a plurality of chambers in flow sequence, each chamber having an array of holes through which the coolant passes and thereby creates a plurality of coolant jets that impinge on a radially inner surface or a radially inner wall of the seal segment.

Preferably, the coolant flows through the chambers generally in a downstream direction with respect to the general flow of gas products through the engine.

Preferably, the impingement plate or device comprises a ceramic material.

Alternatively, the impingement plate or device is metallic.

Preferably, the seal segment is held in position via a mounting sleeve, which is mounted to a cassette via fasteners.

Preferably, the mounting sleeve comprises a ceramic matrix composite material.

Preferably, the cassette is a metallic material.

The present invention will be more fully described by way of example with reference to the accompanying drawings in which.

Figure 1:
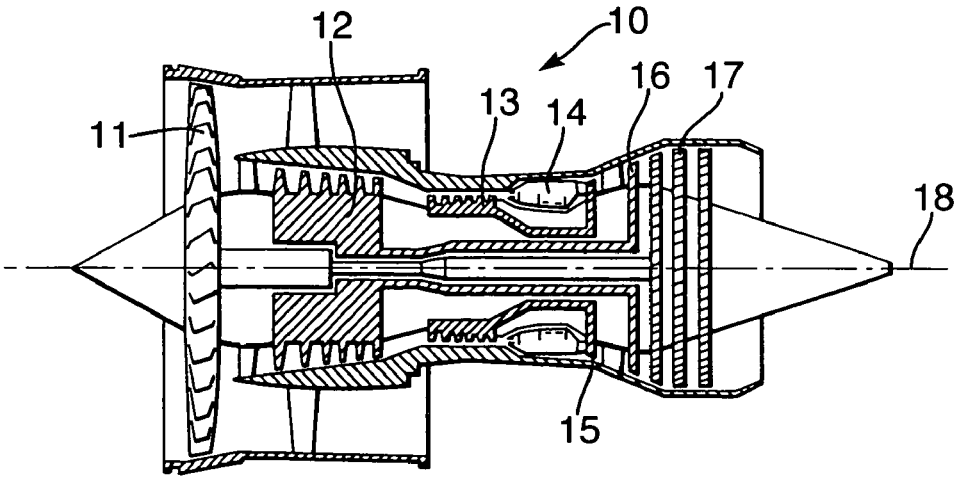
FIG. 1 is a generalized schematic section of a ducted fan gas turbine engine.

With reference to FIG. 1, a ducted fan gas turbine engine generally indicated at 10 is of generally conventional configuration. It comprises, in axial flow series, a propulsive fan 11, intermediate and high pressure compressors 12 and 13 respectively, combustion equipment 14 and high, intermediate and low pressure turbines 15, 16 and 17 respectively. The high, intermediate and low pressure turbines 15, 16 and 17 are respectively drivingly connected to the high and intermediate pressure compressors 13 and 12 and the propulsive fan 11 by concentric shafts which extend along the longitudinal axis 18 of the engine 10.

The engine 10 functions in the conventional manner whereby air compressed by the fan 11 is divided into two flows: the first and major part bypasses the engine to provide propulsive thrust and the second enters the intermediate pressure compressor 12. The intermediate pressure compressor 12 compresses the air further before it flows into the high-pressure compressor 13 where still further compression takes place. The compressed air is then directed into the combustion equipment 14 where it is mixed with fuel and the mixture is combusted. The resultant combustion products then expand through, and thereby drive, the high, intermediate and low-pressure turbines 15, 16 and 17. The working gas products are finally exhausted from the downstream end of the engine 10 to provide additional propulsive thrust.

The high-pressure turbine 15 includes an annular array of radially extending rotor aerofoil blades 19, the radially outer part of one of which can be seen if reference is now made to FIGS. 2-6. Hot turbine gases flow over the aerofoil blades 19 in the direction generally indicated by the arrow 20. A shroud ring 21 in accordance with the present invention is positioned radially outwardly of the aerofoil blades 19. It serves to define the radially outer extent of a short length of the gas passage 36 through the high-pressure turbine 15.

The turbine gases flowing over the radially inner surface of the shroud ring 21 are at extremely high temperatures. Consequently, at least that portion of the shroud ring 21 must be constructed from a material that is capable of withstanding those temperatures whilst maintaining its structural integrity. Ceramic materials, such as those based on silicon carbide fibres enclosed in a silicon carbide matrix are particularly well suited to this sort of application. Accordingly, the radially inner part 56 of the shroud ring 21 is at least partially formed from such a ceramic material.

Referring now to FIGS. 2-6, the present invention relates to a shroud ring 21 having a seal segment 30, comprising a ceramic matrix composite material (CMC) and having a cooling arrangement. The seal segment 30 is one of an annular array of seal segments 32. Each segment 30 is held at both its circumferential ends 30*a*, 30*b* by inner mounting sleeves 34. The inner mounting sleeves 34, also comprise a ceramic matrix composite material, are in turn mounted to a cassette 38 via 'daze' fasteners 40 (as described in U.S. Pat. No. 4,512,699 for example) which are particularly suitable for securing components having materials with significant differential thermal expansion.

Figure 2:
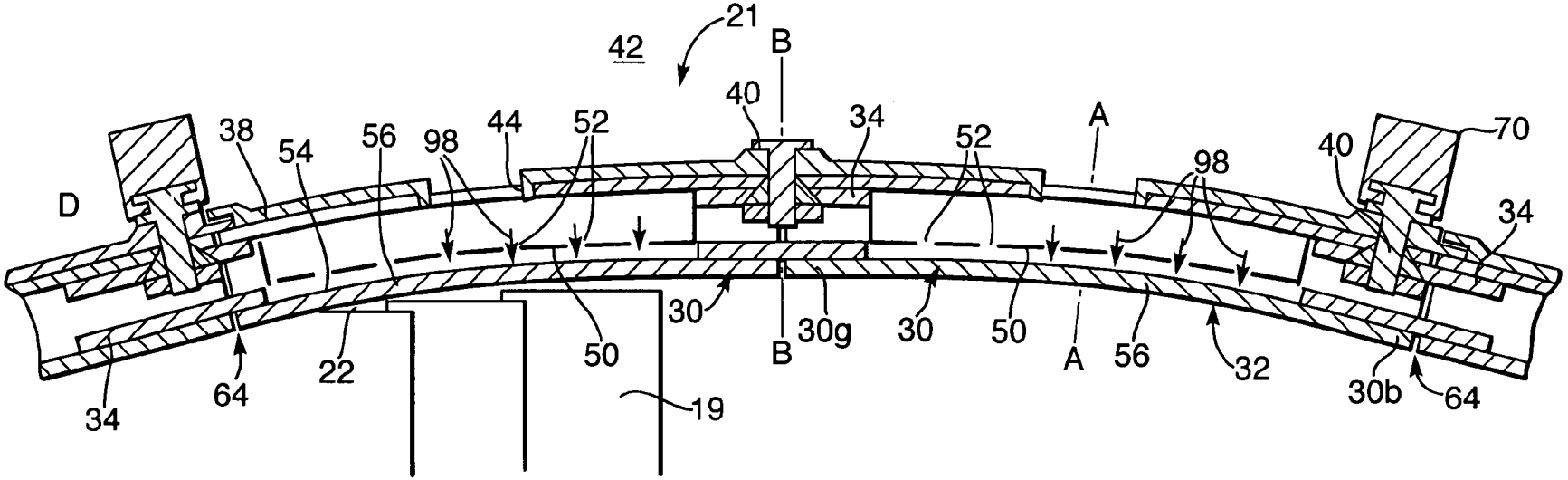
FIG. 2 is a schematic arrangement of a shroud ring including a cassette, a ceramic mounting sleeve and a seal segment assembly, including an impingement plate in accordance with the present invention.
Figure 2A:
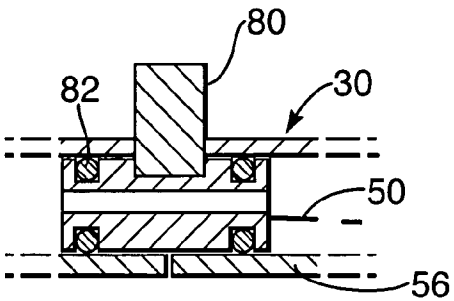
FIG. 2A is a view on D in FIG. 2 and shows an alternative metallic mounting to the ceramic mounting sleeve.
Figure 4:
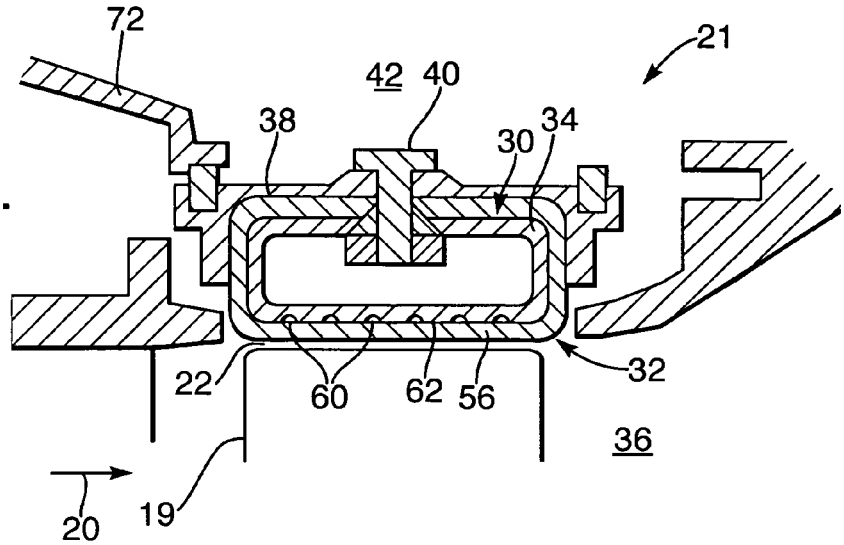
FIG. 4 is a section BB in FIG. 2, showing circumferential grooves in the mounting sleeve to allow spent cooling air to escape via gaps between seal segments into an annulus in accordance with the present invention.
Figure 5:
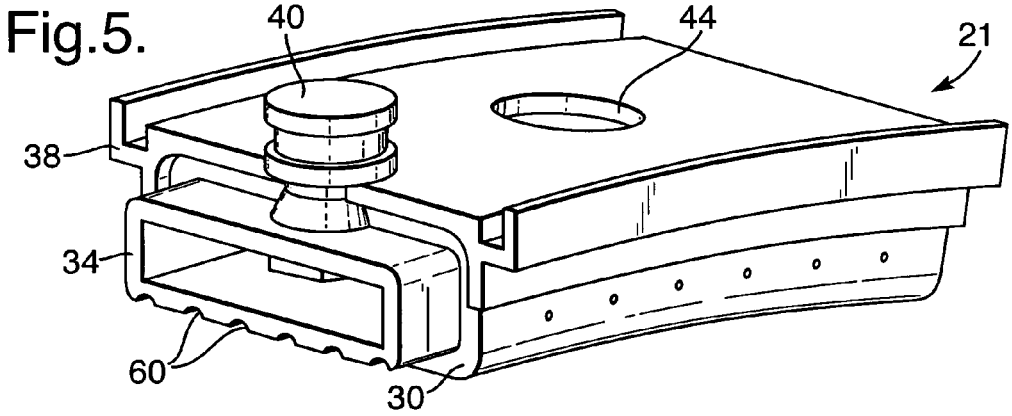
FIG. 5 is a perspective view of seal segment assembly including an inlet hole for cooling air in accordance with the present invention.
Figure 6:
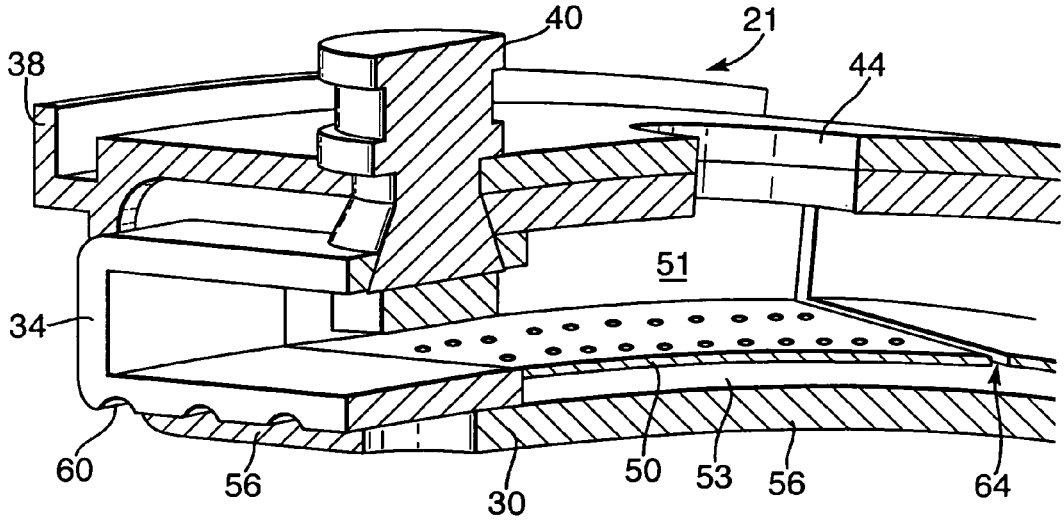
FIG. 6 is a perspective cut away view of cassette, segment, inner mounting sleeve and mounting bolt in accordance with the present invention.

FIG. 2A is a view on D in FIG. 2 and shows an alternative metallic mounting 80 to the ceramic mounting sleeve 34. A braid type seal 82 comprising ceramic fibres encased in a braided metallic sleeve provides a seal between the hollow seal segment 30 and the metallic mounting 80.

The inner mounting sleeves 34 form a mechanical load path that reacts the pressure differential (radially) across the segment 30 due to the lower gas pressure in the annulus 36 compared to the gas pressure in the radially outer space 42 of the segments 30. The outer space 42 is fed compressed air from the high-pressure compressor 13.

In this exemplary embodiment, there are two seal segments 30 per cassette 40, however there could be more than two or single segments 30 could be mounted in an individual cassette 40.

Each seal segment 30 comprises a generally hollow box with approximately rectangular cross section and which contains an impingement plate 50 that defines an array of holes 52. The impingement plate 50 spans the interior space of the seal segment 30 defining therewith radially inner and outer chambers 51, 53.

A hole 44 is defined through the radially outer walls 46, 48 (FIGS. 3, 5, 6) of the cassette 38 and segment 30. Thus, in use, the pressure differential forces the relatively cool compressor delivery gas, in space 42, through the hole 44 and to flow through the impingement plate 50, before being ejected into the annulus gas path 36.

The holes 52 each produce relatively high velocity jets 98 that generate high heat transfer on the radially outer surface 54 of the radially inner wall 56 of the seal segment 30. Thus, in this way, the CMC segment 30 is kept relatively cool as well as any protective or abradable lining (not shown, but disposed to the radially inner surface of the seal segment 30) at an acceptable temperature.

The present invention is thus advantageous over U.S. Pat. No. 5,962,076 as it utilizes a high performance cooling arrangement and is therefore capable of operating within a higher temperature environment and/or has a longer service life. The material used to make the segment 30 is a high performance CMC, typically a silicon melt infiltrated variant which has an inherently high thermal conductivity compared to earlier CMC materials. A typical fibre pre-form for the segment is braiding, as this allows a continuous seal segment tube 30 to be formed reducing raw material wastage as well as providing through thickness strength. Alternatively, the seal segment fibre pre-form could be filament wound around a mandrel or consist of two-dimensional woven cloth wrapped around a mandrel.

The impingement plate 50 comprises the same CMC material as the seal segment 30. This material choice is preferable as the two components fuse together during the silicon melt infiltration process. This has the advantage of allowing good sealing of joints and reduces the risk of leakage of cooling air around the plate 50.

Figure 3:
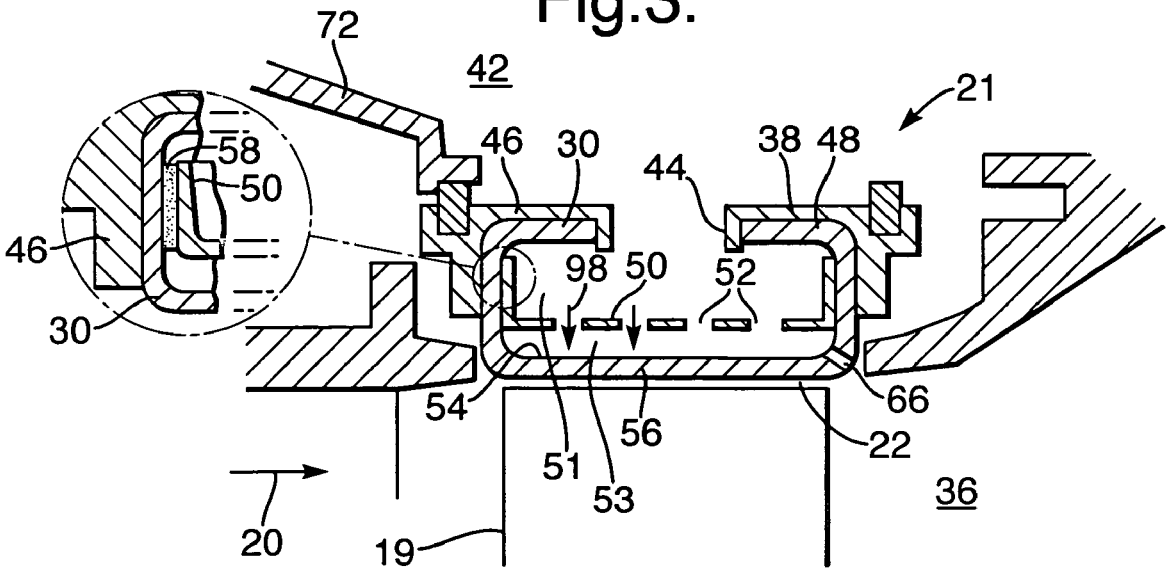
FIG. 3 is a section AA in FIG. 2, showing trailing edge holes that allows spent cooling air into a main gas flow annulus and along a leakage path between the seal segment and the cassette in accordance with the present invention.

Alternatively, and as shown in enlarged view on FIG. 3, the impingement plate 50 may be metallic and inserted into the hollow seal segment 30 prior to the assembly of the segment 30 into the cassette 38. In this case a braided sealing media 58 is used to limit unwanted leakage between the impingement plate 50 and the seal segment 30.

The ceramic seal segment 30 is preferably in the form of a hollow box section and which acts as a beam spanning between sleeves 34. The seal segment 30 resists the radial force of the pressure differential between the high-pressure compressor delivery air on its radially outer side 42 and the lower pressure annulus air on its radially inner side 36.

The holes 52 in the impingement plate 50 are arranged in a pattern suitable to minimize in-plane thermal gradients in the CMC material of the seal segment 30. It should be appreciated that the size of the holes 44 may be different, again to optimize coolant flow to have a preferable thermal gradient across the seal segment 30. Spent air from the impingement system is ejected into the rotor annulus 36 via grooves 60 defined in the radially inward surface 62 of the mounting sleeve 34 and then through an axial gap 64 between the segments 30 and/or via holes 66 defined in a downstream portion of the segment 30.

Where the mounting sleeve 34 and seal segment 30 overlap the coolant passes through the channels 60, thereby providing cooling to the ceramic wall 56. The circumferential edges of the seal segments 30 are also cooled as the coolant exits through the axial gap 64.

Figure 7:
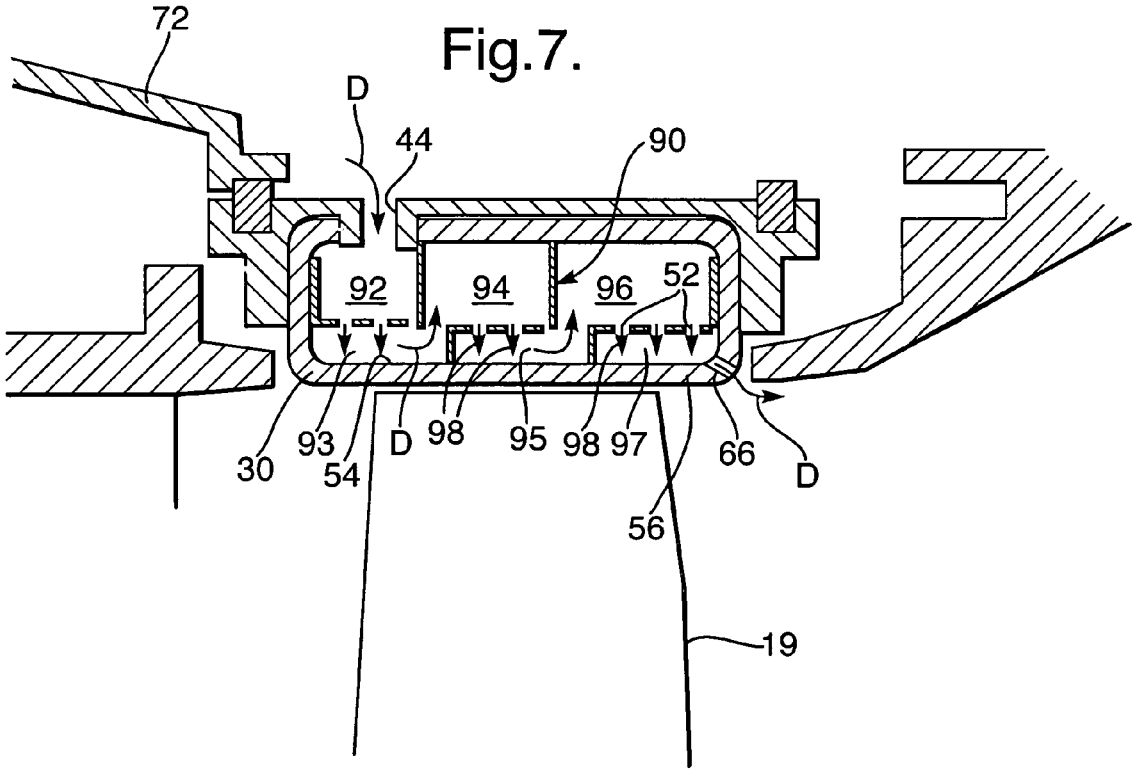
FIG. 7 is a section similar to AA in FIG. 2, showing a cascade impingement device, which is an alternative to the impingement plate and in accordance with the present invention.

Referring to FIG. 7, the impingement plate 50 has been replaced by a cascade impingement device 90, which is housed within the hollow section seal segment 30. The cascade impingement device 90 defines a plurality of chambers 92-97 in coolant flow (arrows D) sequence. Each chamber 92-97 defines an array of holes 52 through which the coolant passes thereby creating a plurality of coolant jets 98 that impinge on the radially inner surface 54 of a radially inner wall 56 of the seal segment 30. Preferably and as shown, the coolant flows into a first chamber 92 through the feed hole 44 and then through consecutive chambers 93-97 generally in a generally downstream direction with respect to the general flow (arrow 20) of gas products through the engine 10. Thus in this configuration of cascade 90, the coolest air cools the hottest (in this case upstream) part of the seal segment 30.

It should be appreciated that in other applications the coolant flow may pass circumferentially or in an upstream direction or in a combination of any two or more upstream, downstream and circumferential directions.

In the interests of overall turbine efficiency, the radial gap 22 between the outer tips of the aerofoil blades 19 and the shroud ring 21 is arranged to be as small as possible. However, this can give rise to difficulties during normal engine operation. As the engine 10 increases and decreases in speed, temperature changes take place within the high-pressure turbine 15. Since the various parts of the high-pressure turbine 15 are of differing mass and vary in temperature, they tend to expand and contract at different rates. This, in turn, results in variation of the tip gap 22. In the extreme, this can result either in contact between the shroud ring 21 and the aerofoil blades 19 or the gap 22 becoming so large that turbine efficiency is adversely affected in a significant manner.

Figure 8:
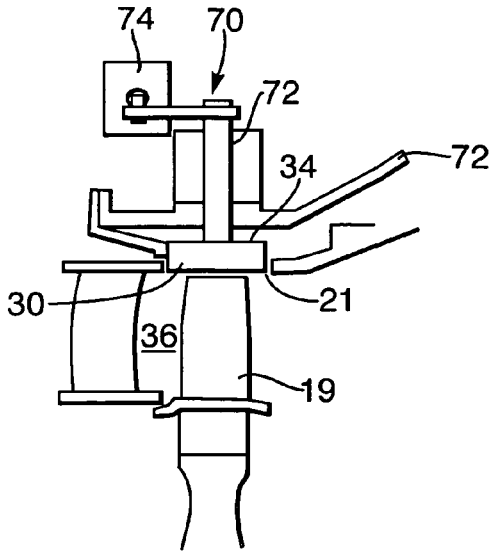
FIG. 8 is a schematic section showing the rotor shroud ring arrangement of the present invention including a tip clearance control system.

In the present invention, the rotor shroud ring arrangement 21 includes a tip clearance control system 70 as shown in FIG. 8. The tip clearance control system 70 comprises an actuator 74 connected to an actuation rod 72, which is capable of varying the radial position of the cassettes 38 and thus the seal segments 30. Each cassette/seal segment assembly 38, 30 is directly mounted on an actuation rod 72 at one end and which moves that end of the cassette 38 radially inwardly and outwardly. The other end of the cassette 38 is free to slide with respect to the adjacent cassette/seal segment assembly 38, 30. The sliding joint is designed to allow a degree of circumferential growth, and therefore radial growth in order to facilitate a tip clearance 22 control system 70. The end of the cassette 38 that is not directly actuated is thus moved radially inwards and outwards via its neighbouring cassette 38 that is directly driven by the circumferentially adjacent actuator 74.

Where a closed loop tip clearance control system is desired, the actuation rods may incorporate mounting holes for tip gap 22 probes, such as capacitance probes. To allow good control of tip clearance 22, an abradable material, similar to that described in U.S. Pat. No. 6,048,170, or a porous coating applied by plasma spraying or high velocity oxy-fuel spraying may be applied.

Although such a tip clearance control system 70 is preferable, it is possible to implement a fixed shroud ring 21. This fixed shroud ring comprises a similar mounting arrangement, with the cassettes 38 engaging with hard mountings (e.g. hooks) on a casing 72 (see FIGS. 3 and 4). In this case, a degree of tip clearance control could be accomplished via temperature control of the casing, in which controlled thermal growth or contraction of the casing is used to control the radial position of the seal segment.

An advantage of this cooled ceramic seal segment 30 is that the fastenings 40, which are required to be robust and therefore metallic, and the cassette 38 are substantially isolated from the particularly hot high-pressure turbine gases.

We claim:

1. A ceramic seal segment for a shroud ring of a rotor of a gas turbine engine, the ceramic seal segment positioned radially adjacent the rotor, the ceramic seal segment being a box section with a hollow interior that defines an inlet and an outlet for passage of coolant therethrough.

2. A ceramic seal segment as claimed in claim 1 wherein an impingement plate is provided within the hollow section seal segment, the impingement plate defining an array of holes through which the coolant passes and thereby creates a plurality of coolant jets that impinge on a radially inner surface or a radially inner wall of the seal segment.

3. A ceramic seal segment as claimed in claim 2 wherein the impingement plate or device comprises a ceramic material.

4. A ceramic seal segment as claimed in claim 2 wherein the impingement plate or device is metallic.

5. An array of ceramic seal segments as claimed in claim 1 wherein the outlet is an axial gap between segments.

6. An array of ceramic seal segments as claimed in claim 1 wherein the seal segments are held in position via a mounting sleeve and the mounting sleeve is hollow and allows cooling fluid to flow between adjacent ceramic seal segments.

7. A ceramic seal segment for a shroud ring of a rotor of a gas turbine engine, the ceramic seal segment positioned radially adjacent the rotor and characterised by being a hollow section that defines an inlet and an outlet for the passage of coolant therethrough, wherein a cascade impingement device is provided within the hollow section seal segment, the cascade impingement device defining a plurality of chambers in flow sequence, each chamber having an array of holes through which the coolant passes and thereby creates a plurality of coolant jets that impinge on a radially inner surface or a radially inner wall of the seal segment.

8. A ceramic seal segment as claimed in claim 7 wherein the coolant flows through the chambers generally in a downstream direction with respect to a general flow of gas products through the engine.

9. A ceramic seal segment as claimed in claim 7 wherein an impingement plate is provided within the hollow section seal segment, the impingement plate defining an array of holes through which the coolant passes and thereby creates a plurality of coolant jets that impinge on a radially inner surface or a radially inner wall of the seal segment.

10. A ceramic seal segment as claimed in claim 9 wherein the impingement plate or device comprises a ceramic material.

11. A ceramic seal segment as claimed in claim 9 wherein the impingement plate or device is metallic.

12. A ceramic seal segment for a shroud ring of a rotor of a gas turbine engine, the ceramic seal segment positioned radially adjacent the rotor and characterised by being a hollow section that defines an inlet and an outlet for the passage of coolant therethrough, wherein the seal segment is held in position via a mounting sleeve, which is mounted to a cassette via fasteners.

13. A ceramic seal segment as claimed in claim 12 wherein the mounting sleeve comprises a ceramic matrix composite material.

14. A ceramic seal segment as claimed in claim 12 wherein the cassette is a metallic material.

15. A ceramic seal segment as claimed in claim 12 wherein an impingement plate is provided within the hollow section seal segment, the impingement plate defining an array of holes through which the coolant passes and thereby creates a plurality of coolant jets that impinge on a radially inner surface or a radially inner wall of the seal segment.

16. A ceramic seal segment as claimed in claim 15 wherein the impingement plate or device comprises a ceramic material.

17. A ceramic seal segment as claimed in claim 15 wherein the impingement plate or device is metallic.

18. An array of ceramic seal segments as claimed in claim 12 wherein the mounting sleeve has a radially inward surface and grooves are defined in the surface.

19. An array of ceramic seal segments as claimed in claim 18 wherein the mounting sleeve is a ceramic matrix composite material.

20. An array of ceramic seal segments as claimed in claim 18 wherein the outlet is an axial gap between segments and air is ejected through the axial gap via the grooves.

* * * * *